US009057313B2

(12) United States Patent
Heeb

(10) Patent No.: US 9,057,313 B2
(45) Date of Patent: Jun. 16, 2015

(54) MUFFLER INCLUDING A RESONATOR SLIDE-IN UNIT

(71) Applicant: GM GLOBAL TECHNOLOGY OPERATIONS LLC, Detroit, MI (US)

(72) Inventor: Gerald Heeb, Ginsheim-Gustavsburg (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 13/692,762

(22) Filed: Dec. 3, 2012

(65) Prior Publication Data

US 2013/0140107 A1 Jun. 6, 2013

(30) Foreign Application Priority Data

Dec. 3, 2011 (DE) ..... 10 2011 120 148

(51) Int. Cl.

| | |
|---|---|
| ***F02M 35/12*** | (2006.01) |
| ***F01N 13/18*** | (2010.01) |
| ***F01N 1/02*** | (2006.01) |
| ***F02M 35/00*** | (2006.01) |
| *F01N 1/00* | (2006.01) |
| *F02M 35/10* | (2006.01) |
| *F01N 13/00* | (2010.01) |

(52) U.S. Cl.

CPC ..... *F01N 13/00* (2013.01); *F02M 35/00* (2013.01)

(58) Field of Classification Search

USPC ..... 181/212, 224, 230, 241, 243, 250; 123/184.21, 184.53, 184.57

See application file for complete search history.

(56) References Cited

U.S. PATENT DOCUMENTS

| | | | | |
|---|---|---|---|---|
| 3,176,790 | A * | 4/1965 | Lentz | 181/227 |
| 3,482,648 | A * | 12/1969 | Reeve | 181/227 |
| 4,137,992 | A * | 2/1979 | Herman | 181/213 |
| 4,887,852 | A * | 12/1989 | Hancock | 285/148.13 |
| 5,268,541 | A * | 12/1993 | Pettersson | 181/224 |
| 6,715,580 | B1 * | 4/2004 | Gerstner et al. | 181/224 |
| 6,983,820 | B2 * | 1/2006 | Boast et al. | 181/249 |
| 7,350,619 | B2 * | 4/2008 | Williams | 181/214 |
| 7,631,726 | B2 | 12/2009 | McWilliam et al. | |
| 7,934,581 | B2 * | 5/2011 | Kim et al. | 181/250 |
| 8,408,357 | B2 * | 4/2013 | Cheung | 181/224 |
| 8,459,408 | B2 * | 6/2013 | Murata et al. | 181/228 |
| 8,881,862 | B1 * | 11/2014 | Messer et al. | 181/223 |
| 2004/0194751 | A1 | 10/2004 | Limbrunner et al. | |

(Continued)

FOREIGN PATENT DOCUMENTS

| | | | |
|---|---|---|---|
| DE | 19943246 | A1 | 3/2001 |
| EP | 2101057 | A1 | 9/2009 |
| WO | 2006115461 | A1 | 11/2006 |

OTHER PUBLICATIONS

German Patent Office, German Search Report for Application No. 10 2011 120 148.7 dated Jul. 30, 2012.

*Primary Examiner* — Edgardo San Martin

(74) *Attorney, Agent, or Firm* — Ingrassia Fisher & Lorenz PC

(57) ABSTRACT

A muffler for an intake tract of a combustion engine is provided. The muffler includes a resonator housing, which according to a part segment of an annular body is formed with continuous cross section. The muffler also includes a resonator slide-in unit, which according to a part segment of an annular body is formed with a continuous cross section and which is configured in order to be slid into the resonator housing in a part circle-like movement.

13 Claims, 5 Drawing Sheets

(56) References Cited

U.S. PATENT DOCUMENTS

2004/0238273 A1* 12/2004 Fritskey et al. ..... 181/264
2005/0150718 A1* 7/2005 Knight et al. ..... 181/250
2007/0074930 A1* 4/2007 Tomerlin et al. ..... 181/252
2007/0295554 A1 12/2007 Flucht et al.
2012/0090915 A1* 4/2012 Cheung ..... 181/224

* cited by examiner

MUFFLER INCLUDING A RESONATOR SLIDE-IN UNIT

CROSS-REFERENCE TO RELATED APPLICATION

This application claims priority to German Patent Application No. 10 2011 120 148.7, filed Dec. 3, 2011, which is incorporated herein by reference in its entirety.

TECHNICAL FIELD

The technical field relates to a muffler for a combustion engine.

BACKGROUND

From DE19943246 A1 a muffler for reducing the gear noises in the intake tract of combustion engines has become known, with a resonator housing and with a charge air pipe that can be arranged therein. Between the resonator housing and the charge air pipe, intermediate walls are arranged which form resonance chambers between the charge air pipe and the resonance body. The charge air pipe comprises recesses, which connect the interior of the charge air pipe to the resonance bodies in a fluid-conducting manner. The charge air pipe and the resonator housing substantially extend in a main extension direction.

Accordingly, it may be desirable to provide a muffler for a line portion, in particular for an intake tract in a motor vehicle, with which a limited installation space can be optimally utilized. In addition, other objects, desirable features and characteristics will become apparent from the subsequent summary and detailed description, and the appended claims, taken in conjunction with the accompanying drawings and this background.

SUMMARY

According to various exemplary embodiments, a muffler for an intake tract of a combustion engine is provided. In one example, the muffler can comprise a resonator housing, which corresponding to a part segment of an annular body is formed with a continuous cross section. The muffler can also comprise a resonator slide-in unit, which according to a part segment of an annular body is formed with a continuous cross section and which is configured for the purpose of being slid into the resonator housing in a part circle-like movement.

By doing so, a resonator can be established that runs about a curve. The annular body can have a circular cross section, but it can have cross sections deviating from this, for example elliptical cross sections. In many combustion engines of motor vehicles, the intake air in certain locations has to be diverted in suitable curve portions anyhow. In the past, a resonator could only be arranged in the curve portions with relatively complex welded constructions. Because of the welding margin necessary for this a welded resonator housing takes up more installation space than a curve portion without resonator. The aim, especially with charged engines (for example via mechanically or exhaust gas driven chargers) is to save installation space which can then be utilized for other units or for an improved heat discharge through heat radiation. Through the configuration of the resonator housing and of the resonator slide-in unit with continuous cross sections corresponding to a part segment of an annular body, the muffler can be mounted in a curve of the intake tract.

According to one exemplary embodiment, the resonator housing extends over a part segment angle of about 40° to about 140°, in one example, from about 60° to about 120°, generally from about 80° to about 100°.

According to one exemplary embodiment, the resonator slide-in unit is arranged eccentrically in the resonator housing.

The resonator works according to the Helmholtz-principle. In that the resonator slide-in unit is eccentrically arranged in the resonator housing, resonator volumes with different size can be created about the circumference, which accordingly can dampen or extinguish a wide frequency range. Furthermore, through an eccentric displacement radially to the outside, a narrower curve radius can be described.

According to one exemplary embodiment, the resonator slide-in unit comprises resonator volumes which are connected via an opening each to an interior of a gas-conducting line section.

Here, the resonator volumes can be partially enclosed on the outer circumference by ribs running in axial and radial direction and in the unassembled state can be open towards the outside, wherein the resonator housing in the assembled state closes the resonator volume.

According to one exemplary embodiment, the resonator slide-in unit is formed of two halves produced by a casting method.

Here, the halves can be identical and be demoldable without undercuts, so that a relatively simple construction is ensured. The casting method can be an ejection molding method. By providing two halves, undercuts can be created without having to use insert or slide-in cores during the casting method (for example for the line portion). By doing so, the casting method can also be accelerated.

According to one exemplary embodiment, the resonator slide-in unit accordingly comprises a line portion and radial ribs and annular ribs unitarily connected to the line portion.

According to another exemplary embodiment, the resonator slide-in unit comprises stabilization webs on a connecting portion. With the help of these stabilization webs, the connecting portion can be stabilized from inside, so that a hose clamp clamping the connecting portion can exert a major connecting force on the connecting portion.

The resonator slide-in unit is produced as a finished unit from line portion and ribs molded thereon. During the assembly, the resonator slide-in unit merely has to be slid into the resonator housing. Through the simplified construction with few individual parts the assembly is substantially simplified.

The muffler can be used in an intake tract of a motor vehicle for damping sound waves, which are generated by a charger. Here, the intake tract muffler can be employed both on a suction side as well as on a pressure side.

A person skilled in the art can gather other characteristics and advantages of the disclosure from the following description of exemplary embodiments that refers to the attached drawings, wherein the described exemplary embodiments should not be interpreted in a restrictive sense.

BRIEF DESCRIPTION OF THE DRAWINGS

The various embodiments will hereinafter be described in conjunction with the following drawing figures, wherein like numerals denote like elements, and wherein.

DETAILED DESCRIPTION

Figure 1:
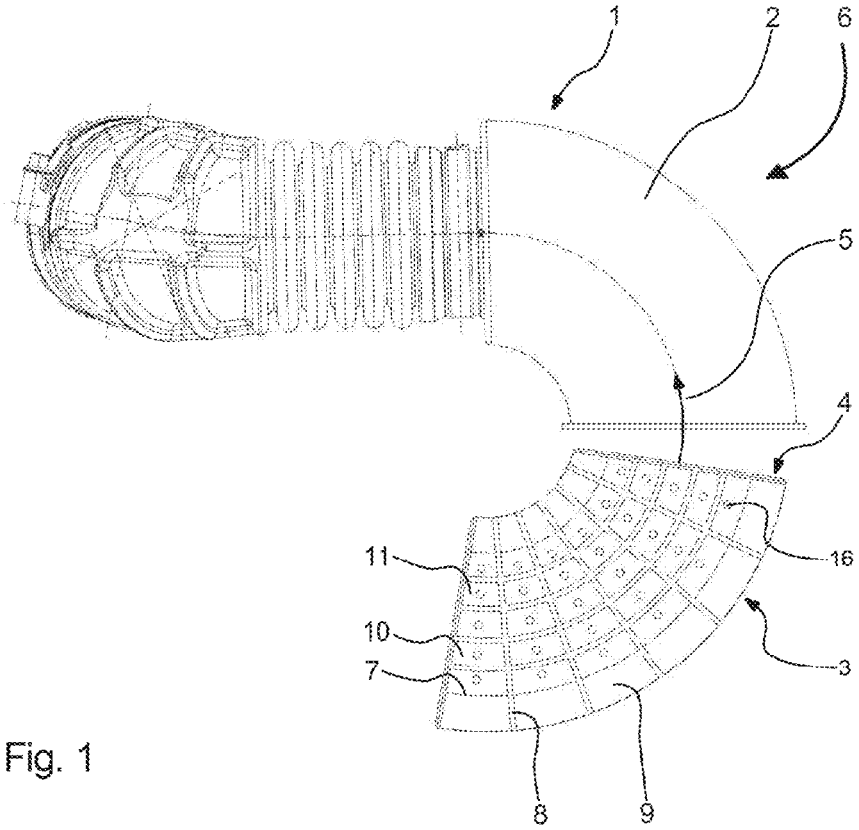
FIG. 1 is a representation of a part of an intake tract of a combustion engine having a resonator housing and having a resonator slide-in unit that can be introduced into the resonator housing.

The following detailed description is merely exemplary in nature and is not intended to limit the present disclosure or the application and uses of the present disclosure. Furthermore, there is no intention to be bound by any theory presented in the preceding background or the following detailed description.

In the Figures, components which are the same or have the functionally same effect are provided with the same reference characters.

FIG. 1 shows a portion 1 of an intake tract for a combustion engine which is not shown. The portion comprises a resonator housing 2, which in its shape corresponds to a part portion of an annular body. The resonator housing 2 can have a circular cross section, it can also be formed elliptically in cross section or flattened in certain areas. In the resonator housing 2, a resonator slide-in unit 3 that is formed correspondingly can be slid in. In the assembled state, the resonator housing 2 and the resonator slide-in unit 3 form a muffler 6 (see FIG. 2). Any point located on a face end 4 of the resonator slide-in unit 3 slid in first describes a part-circular curve as indicated by the arrow 5 in FIG. 1 when sliding-in the resonator slide-in unit 3.

The resonator slide-in unit 3 is substantially formed from a line portion 7 and radially running radial ribs 8 and annular ribs 9 also running axially along the annular shape. The radial ribs 8 and the annular ribs 9 are arranged on the outer circumference on the line portion 7. The radial ribs 8 and the annular ribs 9 form resonator volumes 10 that are open to the outside, which are only closed through the sliding-in of the resonator slide-in unit 3 in the resonator housing 2.

In one example, the resonator slide-in unit 3 is a part that is produced according to the injection molding method. It can be demolded in a step in that a removable core for forming the line portion 7 is inserted during the injection molding process. The resonator slide-in unit 3 however can also be formed of two halves, as a result of which a core for the line portion 7 can be omitted during the production. If all annular ribs 9 are to extend orthogonally from a surface 11 of the line portion 7 on the outer circumference, three or more portions of the resonator slide-in unit 3 can also be cast and if required glued together or welded together.

The portion 1 of the intake tract constitutes a fluid-conducting connection between an air filter which is not shown and an entry of the combustion engine. In one example, in the case with charged engines, whistling noises may develop which can be dampened with a muffler arranged in the portion 1. Here, the muffler can be arranged in flow direction in front of and/or behind the charger.

Figure 2:
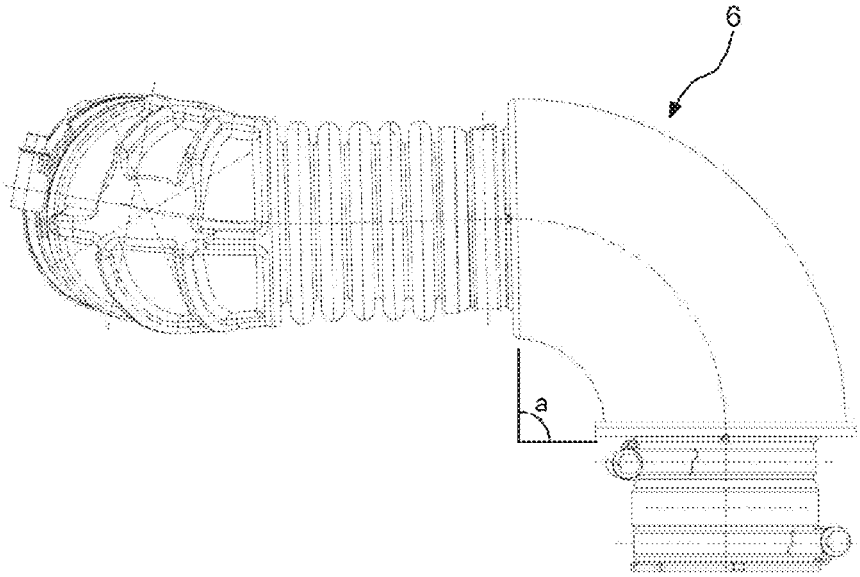
FIG. 2 is a representation of an intake tract with assembled muffler, wherein the resonator slide-in unit is arranged in the resonator housing.

FIG. 2 shows the muffler 6 in an assembled state, in which the resonator slide-in unit is concealed by the resonator housing 2. The muffler 6 extends over a part segment angle a of approximately 80° to about 100°. The part segment angle a depends on the arrangement and spacing of the inlets and outlets of charger, air filter and engine (not shown) to be connected.

Figure 3:
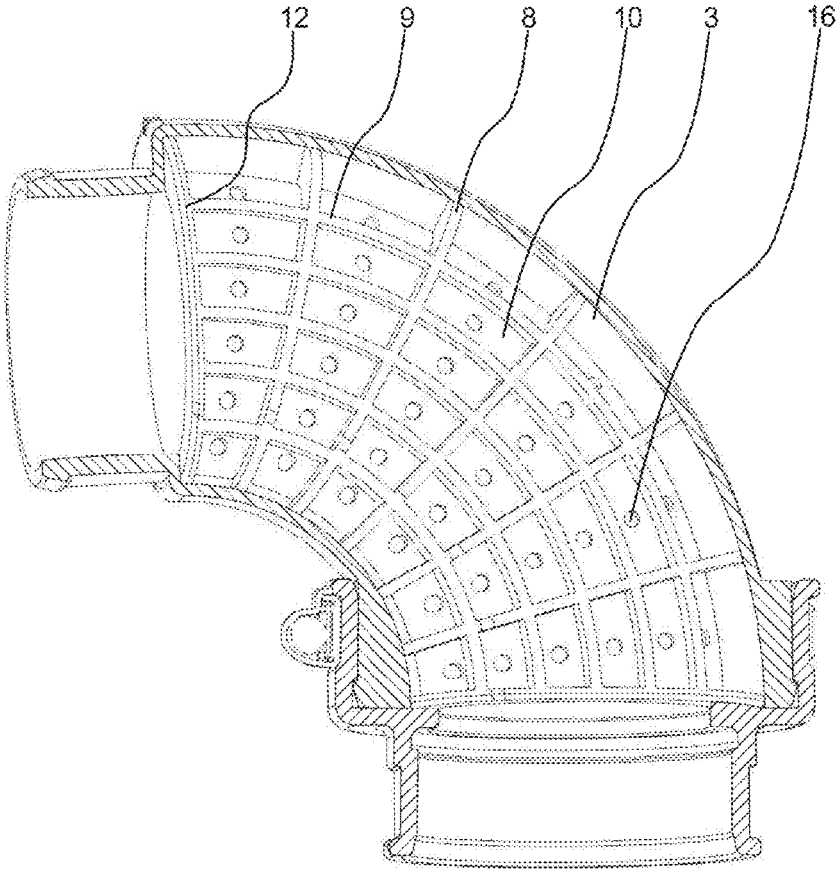
FIG. 3 is a representation of a sectioned resonator housing with the resonator slide-in unit located therein.

FIG. 3 shows the muffler 6 in an enlarged representation with a partially sectioned resonator housing 2. The resonator slide-in unit 3 is formed from two halves, of which only an upper half 12 is visible. It is noticeable that the radial ribs 8 and the annular ribs 9 are oriented so that they can be formed in a casting process, i.e. no undercuts are provided. A tool for producing the halves 12 can have a corresponding negative form of the halves 12 and after the casting method can be opened in an extension direction of the annular ribs 9. The lower half that is not visible can be an identical component. The resonator slide-in unit 3 can be formed of a plastic.

The interior of the line portion 7, through which the intake air is conducted, is connected via an opening 16 each to the resonator volumes 10. The air that is located in each resonator volume 10 forms a spring damper element.

Figure 4:
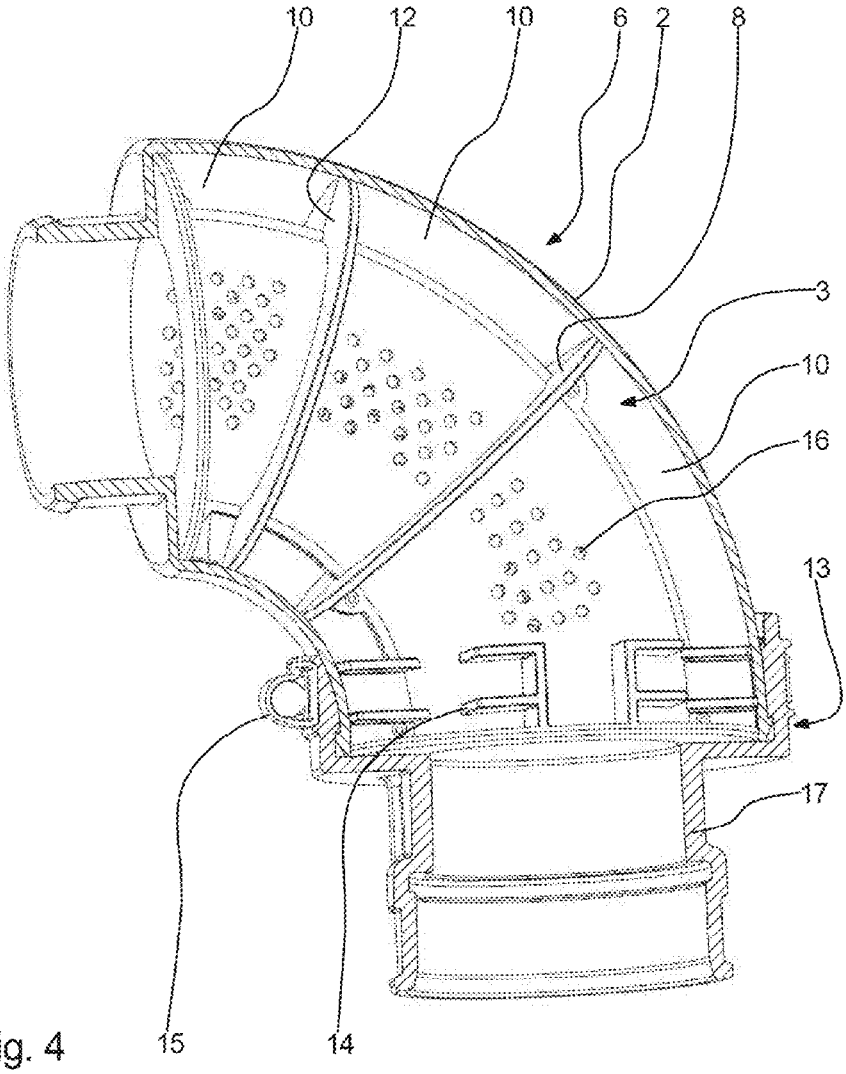
FIG. 4 is a partially sectioned resonator housing with a resonator slide-in unit arranged therein, which comprises three large resonator volumes and on its line portion comprises a plurality of openings leading into the resonator volumes.

FIG. 4 shows an alternative configuration of a muffler 6 with a partially sectioned resonator housing 2 and a line portion 7 located therein with radial ribs 8 arranged on the outer circumference. The radial ribs 8 subdivide the region between the line portion 7 and the resonator housing 2 into three resonator volumes 10 of different size, which are connected to the interior of the line portion 7 via numerous openings 16.

On a connecting portion 13, which can serve for connecting to an ongoing portion 17 (for example an inlet or outlet of a turbocharger). For the inner stabilizing of the connecting portion 13, the resonator slide-in unit 3 comprises stabilizing webs 14 in the region of the connecting portion 13, which stabilize the connecting portion 13 from the inside. On the outer circumference, a hose clamp 15 can be provided for the non-positive and positive connecting of the resonator housing 2 to the ongoing portion 17. So as not to influence the size and in one example, the resonance characteristics of the resonator volume 10, the stabilizing webs 14 are opened and do not themselves form any closed hollow spaces, but rather extend F-like out of the line portion 7 of the resonator slide-in unit 3.

Figure 5:
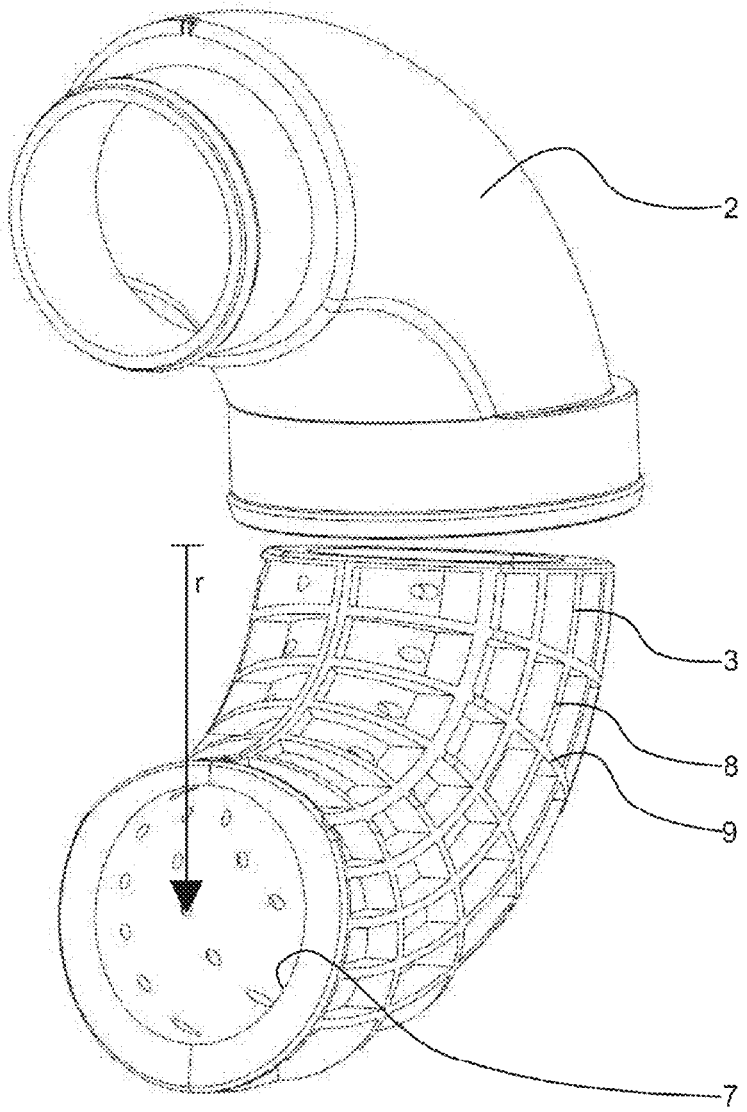
FIG. 5 is a muffler having a resonator slide-in unit eccentrically arranged in the resonator housing.

FIG. 5 shows a muffler 6 with a line portion 7 that can be eccentrically arranged in the resonator housing 2. The eccentric position is formed through radial ribs 8 of different height and annular ribs 9 of different height. Because of this, a relatively narrow curve radius r can be described. In addition, very small resonator volumes 10 can be provided on a region located radially inside.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

What is claimed is:

1. A muffler for an intake tract of a combustion engine, comprising:

a resonator housing having a shape which corresponds to a part segment of an annular body and is formed with a continuous cross section; and a resonator slide-in unit having a shape which corresponds to a part segment of an annular body, is formed with a continuous cross section and which is slid into the resonator housing in a part circle-like movement, the resonator slide-in unit having a plurality of annular ribs spaced apart along an outer circumference of the resonator slide-in unit and a plurality of radial ribs spaced apart along the outer circumference, the plurality of annular ribs intersecting the plurality of radial ribs to form a plurality of resonator volumes, and the resonator slide-in unit is formed along an arc to have a first radius at a first side and a second radius at a second side, the second side opposite the first side, the second radius larger than the first radius and the plurality of resonator volumes increase in volume from the first side to the second side, the resonator slide-in unit having a first portion and a second portion that cooperate to define the resonator slide-in unit, the first portion and the second portion each including the first side and the second side, and the resonator slide-in unit extends continuously from a first end of the resonator housing to a second end of the resonator housing.

2. The muffler according to claim 1, wherein the resonator housing extends over a part segment angle from about 40° to about 140°.

3. The muffler according to claim 1, wherein the resonator housing extends over a part segment angle from about 60° to about 120°.

4. The muffler according to claim 1, wherein the resonator housing extends over a part segment angle from about 80° to about 100°.

5. The muffler according to claim 1, wherein the resonator slide-in unit is eccentrically arranged in the resonator housing.

6. The muffler according to claim 1, wherein the plurality of resonator volumes are each connected to an interior of a line portion via an opening.

7. The muffler according to claim 1, wherein the first portion and the second portion of the resonator slide-in unit are produced according to an injection molding process.

8. The muffler according to claim 1, wherein the resonator slide-in unit further comprises a line portion, and the plurality of radial ribs and the plurality of annular ribs are unitarily connected to the line portion.

9. A motor vehicle, comprising:

an intake track;

a muffler coupled to the intake tract for damping sound waves that are generated by a charger, the muffler including:

a resonator housing having a shape which corresponds to a part segment of an annular body and is formed with a continuous cross section; and a resonator slide-in unit having a shape which corresponds to a part segment of an annular body, is formed with a continuous cross section and which is slid into the resonator housing in a part circle-like movement, the resonator slide-in unit having a plurality of annular ribs spaced apart along an outer circumference of the resonator slide-in unit and a plurality of radial ribs spaced apart along the outer circumference, the plurality of annular ribs intersecting the plurality of radial ribs to form a plurality of resonator volumes, and the resonator slide-in unit is formed along an arc to have a first radius at a first side and a second radius at a second side, the second side opposite the first side, the second radius larger than the first radius and the plurality of resonator volumes increase in volume from the first side to the second side, the resonator slide-in unit having a first portion and a second portion that cooperate to define the resonator slide-in unit, the first portion and the second portion each including the first side and the second side, and the resonator slide-in unit extends continuously from a first end of the resonator housing to a second end of the resonator housing.

10. The motor vehicle according to claim 9, wherein the resonator housing extends over a part segment angle from about 80° to about 100°.

11. The motor vehicle according to claim 9, wherein the resonator slide-in unit is eccentrically arranged in the resonator housing.

12. The motor vehicle according to claim 9, wherein the plurality of resonator volumes are each connected to an interior of a line portion via an opening.

13. The motor vehicle according to claim 9, wherein the resonator slide-in unit further comprises a line portion, and the plurality of radial ribs and the plurality of annular ribs are unitarily connected to the line portion.

* * * * *